US010021923B2

(12) United States Patent
Baker et al.

(10) Patent No.: US 10,021,923 B2
(45) Date of Patent: Jul. 17, 2018

(54) GLOVE WITH POLYMER ENCAPSULATION OF PURPOSE-DRIVEN COMPONENTS

(71) Applicant: Bakner Manufacturing, LLC, Canton, GA (US)

(72) Inventors: Jason Alan Baker, Alpharetta, GA (US); Matthew Lawrence Wagner, Canton, GA (US)

(73) Assignee: BAKNER MANUFACTURING, LLC, Canton, GA (US)

( * ) Notice: Subject to any disclaimer, the term of this patent is extended or adjusted under 35 U.S.C. 154(b) by 0 days.

(21) Appl. No.: 14/604,101

(22) Filed: Jan. 23, 2015

(65) Prior Publication Data

US 2015/0128324 A1 May 14, 2015

Related U.S. Application Data

(60) Provisional application No. 61/931,036, filed on Jan. 24, 2014, provisional application No. 62/020,934, filed on Jul. 3, 2014.

(51) Int. Cl.
*A41D 19/015* (2006.01)
*A41D 19/00* (2006.01)
*A41D 19/04* (2006.01)

(52) U.S. Cl.
CPC ... *A41D 19/0006* (2013.01); *A41D 19/01523* (2013.01); *A41D 19/04* (2013.01)

(58) Field of Classification Search
CPC ..... A41D 19/0006; A41D 19/04; A41D 19/0058; A41D 19/015; A41D 19/01505; A41D 13/00; A41D 13/0012; A41D 13/015; A41D 13/05; A41D 19/001; A41D 19/0065; A41D 19/0082; A41D 19/01523; A41D 2500/54; A41D 31/0011; A41D 31/005; A41D 31/0055; A41D 31/02; B29C 41/14; B29C 2045/0075; B29C 41/20; B29C 41/22; B29C 45/0053; B29C 45/14; B29C 45/1679; B29C 47/021;

(Continued)

(56) References Cited

U.S. PATENT DOCUMENTS 4,497,072 A 2/1985 Watanabe
5,384,083 A 1/1995 Dawn et al.

(Continued)

OTHER PUBLICATIONS

"Interface". Encyclopedia Britannica Online, accessed Jun. 28, 2017, <https:/www.britannica.com/science/interface-physics>.*

(Continued)

*Primary Examiner* — Bobby Muromoto, Jr.
(74) *Attorney, Agent, or Firm* — Baker Donelson; Carl Davis II

(57) ABSTRACT

A work glove with a hand-receiving cavity and a thumb tube and four elongated finger tubes. A resilient pad attaches in a portion selected for providing resistance to industrial loading. A polymer coating encapsulates at least a portion of an exterior surface and the resilient pad within a continuous film, the resilient pad and the polymer coating defining in situ an interfacial miscible layer comprising portions of the resilient pad bonded with the polymer coating, which continuous film resists chemical penetration therethrough while the resilient pad resists industrial loading during use of the work glove.

39 Claims, 12 Drawing Sheets

(58) Field of Classification Search
CPC . B29C 71/04; B29C 73/10; B29L 2031/4864; B29L 2031/753; B29D 11/00865; B29D 99/0067
See application file for complete search history.

(56) References Cited

U.S. PATENT DOCUMENTS

| | | | | |
|---|---|---|---|---|
| D500,394 | S | 12/2004 | VanErmen | |
| D511,864 | S | 11/2005 | VanErmen | |
| D549,396 | S | 8/2007 | VanErmen | |
| D549,397 | S | 8/2007 | VanErmen | |
| D560,036 | S | 1/2008 | VanErmen | |
| D560,037 | S | 1/2008 | VanErmen | |
| D560,038 | S | 1/2008 | VanErmen | |
| D560,039 | S | 1/2008 | VanErmen | |
| D560,040 | S | 1/2008 | VanErmen | |
| D560,314 | S | 1/2008 | VanErmen | |
| 7,469,427 | B2 * | 12/2008 | Yang | A41D 19/0068 2/161.6 |
| 7,771,644 | B2 | 8/2010 | Flather | |
| D695,968 | S | 12/2013 | Ruminski | |
| D695,969 | S | 12/2013 | Ruminski | |
| D703,389 | S | 4/2014 | Ruminski | |
| 8,894,896 | B2 | 11/2014 | Taylor | |
| 9,198,474 | B1 | 12/2015 | Hacobian | |
| 2009/0019613 | A1 | 1/2009 | Carcaterra et al. | |
| 2009/0139011 | A1 | 6/2009 | Vanermen et al. | |
| 2010/0063218 | A1 * | 3/2010 | Iavarone | A61K 8/87 525/433 |
| 2011/0179551 | A1 | 7/2011 | Vanermen | |
| 2012/0204321 | A1 * | 8/2012 | Connelly | A41D 19/04 2/161.6 |
| 2013/0260207 | A1 * | 10/2013 | Uemura | H01M 2/16 429/144 |
| 2013/0269076 | A1 | 10/2013 | Arnone | |
| 2013/0283864 | A1 | 10/2013 | Vanermen et al. | |
| 2013/0305430 | A1 | 11/2013 | Tomono | |
| 2014/0173799 | A1 | 6/2014 | Vanermen et al. | |
| 2015/0082508 | A1 | 3/2015 | Taylor | |

OTHER PUBLICATIONS

International Preliminary Report on Patentability, PCT/US15/12618 (dated Jul. 30, 2015).
Written Opinion, International Searching Authority, PCT/US15/12618 (dated Apr. 14, 2015).

* cited by examiner

GLOVE WITH POLYMER ENCAPSULATION OF PURPOSE-DRIVEN COMPONENTS

TECHNICAL FIELD

The present invention relates to gloves. More particularly, the present invention relates to gloves provided with purpose driven pads and encapsulated within a protective coating as a unified layer for protecting a hand of a person wearing the glove against industrial loading and penetration during use of the work glove.

BACKGROUND OF THE INVENTION

Gloves with impact and vibration resistance exist in the market today. There are several typical methods for providing the impact resistance for gloves, including sewing of Thermal Plastic Rubber (TPR) strips on the back or front of a textile based glove. These glove products are provided in the marketplace by various suppliers, including MECHANIX WEAR, HEXARMOR, RINGERS, and IRON CLAD. More recently, injection molded foamed neoprene technology was introduced by Atom Corporation in Japan.

While these glove offer some protection for hands of users from industrial loading, there are drawbacks in that these gloves lack chemical protection. One recent technology involves sewing or injection molding TPR onto textile shells, sewing another layer of textile over the TPR, and coating the glove. This creates a sandwich-type glove with TPR in a middle layer.

Typical impact and/or anti-vibration gloves only provide impact and/or vibration resistance with little to no liquid/chemical resistance against oil, grease, or other common liquids encountered in application. Where chemical resistance is also offered, it is usually in multiple layers. An example of a multi-layer format is a textile layer+TPR layer+textile layer+polymer layer. This format however results in a bulky, uncomfortable, less integrated system that may increase injury risk and adds unnecessary cost in assembly. Typically, sewn TPR or other material may create snag dangers when in use.

Accordingly, there is a need in the art for an improved glove for protecting a person's hand from industrial loading and chemical penetration during use of the glove. It is to such that the present invention is directed.

SUMMARY OF THE PRESENT INVENTION

The present invention meets the need in the art for an improved glove for protecting a person's hand from industrial loading and chemical penetration during use of the glove. The present invention provides a work glove, comprising a sheet formed to define a hand-receiving cavity having a palm portion and opposing back portion with an elongated thumb tube and four elongated finger tubes extending therefrom and an opposing cuff portion. At least one resilient pad attaches to the sheet in a portion selected for being resistant to industrial loading. A polymer coating encapsulates at least a portion of an exterior surface of the sheet and the at least one resilient pad within a continuous film to define the work glove, with the resilient pad and the polymer coating defining in situ an interfacial miscible layer comprising portions of the resilient pad bonded with the polymer coating. The continuous film resists chemical penetration therethrough and the resilient pad resists industrial loading during use of the work glove.

In another aspect, the present invention provides a method of making a work glove, comprising the steps of:

(a) forming a hand-receiving cavity with a sheet and having a palm portion and opposing back portion with an elongated thumb tube and four elongated finger tubes extending therefrom and an opposing cuff portion;

(b) attaching at least one resilient pad in a portion selected for being resistant to industrial loading; and (c) encapsulating at least a portion of an exterior surface of the sheet and the at least one resilient pad within a continuous polymer film, the resilient pad and the polymer coating defining in situ an interfacial miscible layer comprising portions of the resilient pad bonded with the polymer coating, which film resists chemical penetration therethrough and which resilient pad resists industrial loading during use as a glove during work.

Other features, objects, and advantages of the present invention may become apparent upon a reading of the following detailed description in conjunction with the drawings and the appended claims.

DETAILED DESCRIPTION

Definitions, Terms, Elements

Figure 1:
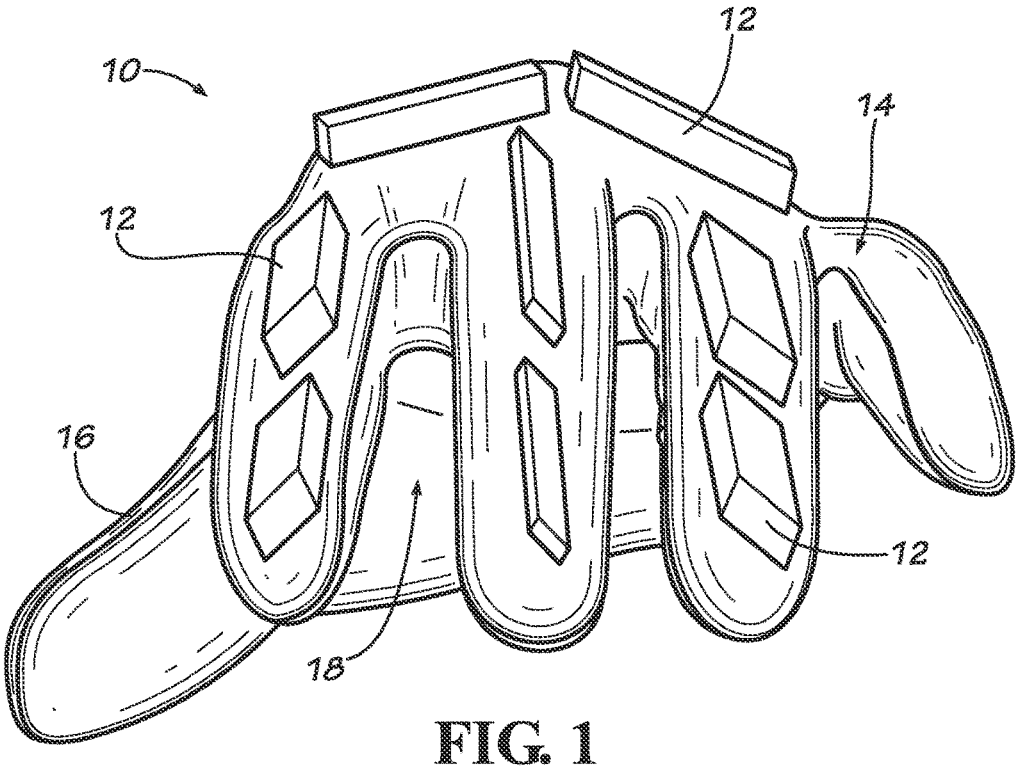
FIG. 1 illustrates in perspective view a glove in accordance with the present invention.

The disclosure uses the following terms and meanings:

- Encapsulation—encase or merge; seal a surface from passage of contaminants therethrough
- Flock—very short or pulverized fiber or powder that forms a bonding materials structure between a polymer pad and an encapsulation layer
- Impact resistant—resistant to force loading or impacts from hard objects or surfaces
- Industrial loading—force impact, abrasion, vibration, slips, scuffing and other load risk forces directed by equipment and tools against a person during industrial processes and work
- Polymer pad—rubberized resilient pad of a polymer material
- Purpose-driven—providing resilient pads of suitable dimensional configuration and arrangement to a glove liner for resisting industrial loading of types experienced in particular crafts and trades
- Vibration resistant—resistant to communicating vibrations, typically received from mechanical equipment Referring now in more detail to the drawings, FIG. 1 illustrates in perspective view a glove 10 in accordance with the present invention. The glove 10 comprises one or more purpose driven polymer pads 12 attached to a glove-defining liner 14 and encapsulated in a chemical protective polymer coating 16 with an interfacial boundary 17 (best illustrated in FIG. 8A) therebetween formed in situ during manufacture. The glove 10 is at least partially, or alternatively fully coated, on an exterior surface of the liner 14 and the pad 12 with the chemical protective polymer coating 16. The coating 16 fully encapsulates the polymer pads 12 to become a unified layer involving the liner 14 to which the pads 12 attach and the coating 16. The resulting glove 10 in variations protects the hand against industrial loading such as impacts, abrasion, vibration, slips, and other force risks. The variations of the glove 10 derives from being designed to meet the particular industrial application with purpose-driven pads 12. The encapsulating chemical polymer coating 16 protects from common general liquids and industrial chemicals such as oil and solvents, or other contaminants that are preferably restricted from contact with skin.

The encapsulated polymer pad 12 is processed to become an integral part of the chemical protective coating 16 through chemical bonding at an interfacial surface layer 17 of these miscible materials of the two components. The pads 12 are prepared on the glove textile liner 14 substrate in various patterns and heights on the back or palm of the liner in order to provide optimal protection for a particular purpose-driven industrial application for the gloves 10. The pads 12 are then coated with a continuous layer of a chemical protective polymer, which encapsulates the polymer pad at the interfacial surface layer 17 and integrates the pad and the coating 16 into a continuous protective layer.

Gloves 10 made in accordance with the present invention may be produced in the following four steps: liner 14 preparation, screening of purpose-driven polymer pads 12, encapsulating with the polymer coating 16, and finishing.

Liner 14 Preparation

Figure 2A:
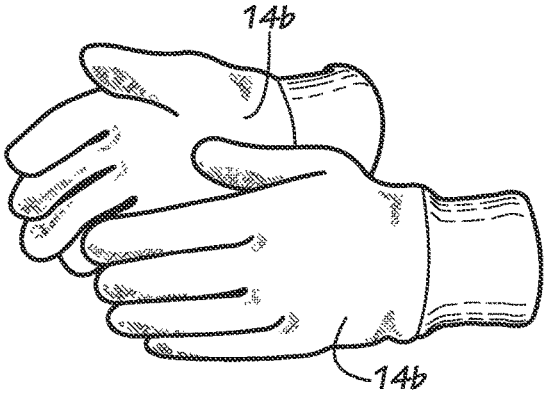
FIG. 2A illustrates a seamless knit liner useful with the glove of the present invention.
Figure 2B:
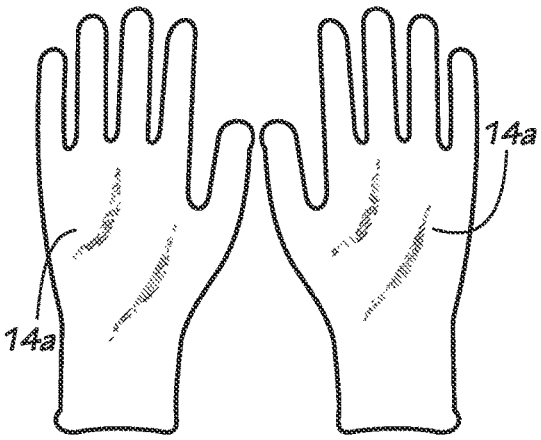
FIG. 2B illustrates a cut and sewn liner useful with the glove of the present invention.

The fabric liner 14 supports the encapsulated impact polymer pads 12. The fabric liners 14 may be a knitted glove 14*a* shown in FIG. 2A formed on conventional seamless glove kitting machines or cut and sewn gloves 14*b* shown in FIG. 2B assembled from panels cut from sheets of textile fabric. Liner preparation uses typical processes generally known in the market.

Performance Driven Polymer Pads 12

The gloves 10 include at least one purpose-driven pad 12 for resisting industrial loading imposed on a glove worn by a person during work. One embodiment for preparation of the polymer pads 12 uses polymers combined with optimal ranges of softeners and blowing agents to provide appropriate required flexion, impact protection, vibration absorption, and texture. The polymer is prepared in a high viscosity paste. High viscosity is required in order to retain the shape of the pad 12 through processing, otherwise, the pad may deform before thermal setting.

Figure 3A:
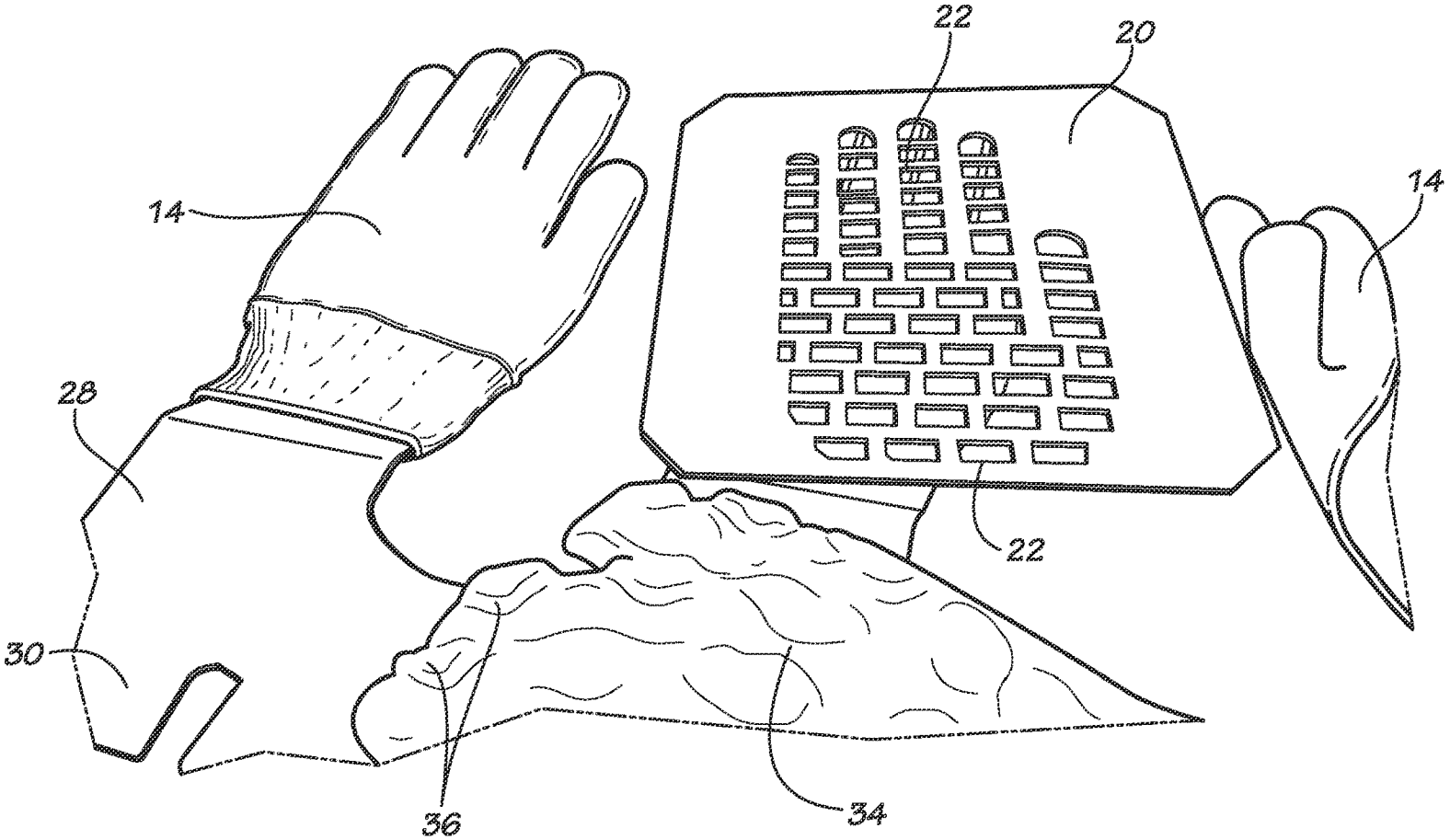
FIG. 3A illustrates an embodiment of a hard block used to screen print pads on the liner for gloves in accordance with the present invention.
Figure 3B:
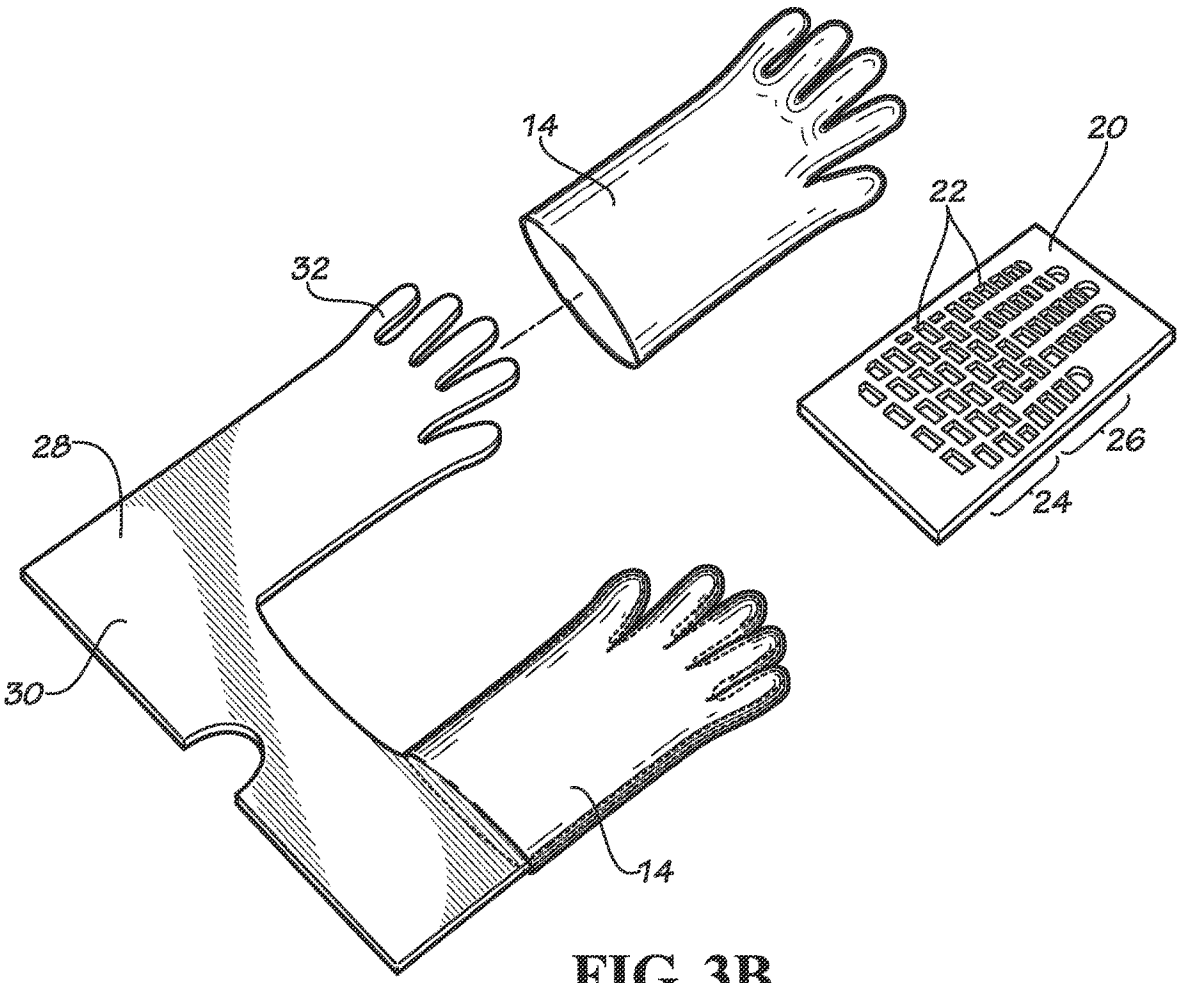
FIG. 3B illustrates in exploded view a form for use in manufacturing the gloves of the present invention.

FIG. 3A illustrates a hard block 20 used to screen print the polymer pad 12 on the liner 14 for gloves 10 in accordance with the present invention. The blocks 20 define openings 22 in selected portions for screening of the polymer material to form and place the pads 12 on the liner 14. The hard block 20 may be made of a stainless steel block or other suitable material for screening polymer material onto the liner 14. The hard block 20 defines at least one opening 22 corresponding to the dimensional configuration of the pad 12 to be printed on the liner 14. FIG. 3A illustrates a plurality of openings 22 spaced-apart generally 24 across a hand-back or palm portion and openings arranged spaced-apart linearly longitudinally generally 26 along a length of a respective digit (finger or thumb) envelope of the glove. A form 28 has a base 30 and a holder 32 for receiving and holding the liner 14 during the printing step. The illustrated form 28 includes a pair of holders 32, as best illustrated in FIG. 3B. A resilient hand-shaped formative 34 with a plurality of projecting members 36 (or pads) is depicted in FIG. 3A.

FIG. 3B illustrates the form 28 with one liner 14 spaced from the holder 32 and another liner 14 received on the second of the holders 32, with one hard block 20 spaced apart from assembly prior to print screening of the pads 12. The hard block 20 aligns with the liner 14 on the form 28.

Polymer paste is then screened across the hard block 20, or silk screen, onto the seamless knit or cut/sewn liner 14 either on the back of the hand or the palm region 18. The cut/sewn liner 14 may be a fully assembled glove or just one panel. The hard block 20, or silk screen overlay, provides the appropriate dimensional configuration for a proper pattern and thickness required for the position and thickness of the impact and anti-vibration polymer pads 12. Typical required impact and anti-vibration pads are between 2 mm and 10 mm height and various widths of various geometry ranging from small areas of 2 mm size, to complete coverage of one side of the hand.

Figure 4A:
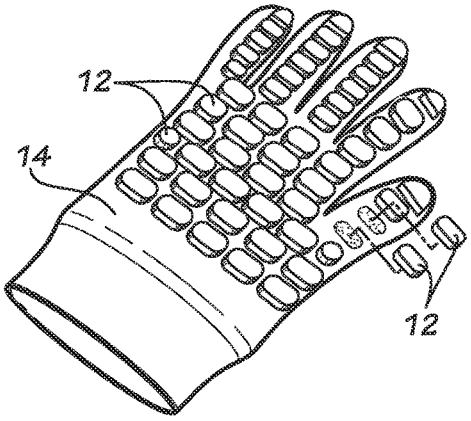
FIG. 4A illustrates an embodiment of a cured/hardened impact and/or anti-vibration polymer coated liners for a glove.

The screened polymer glove liners 14 are then processed further to cure/harden/dry the polymer and fix it attachingly to the glove liner to form a finished shell ready for encapsulation discussed below. Typical process involves drying/curing in an oven for between 30 seconds to 5 minutes at a suitable temperature for the particular polymer. The cure temperature and dwell time is selected for the particular polymers in the glove application. FIG. 4A illustrates a cured/hardened impact and/or anti-vibration polymer pad attached liner 14. The resulting polymer pads 12 are typically at similar heights as the thickness of the hard block 20 or silk screen. The pads 12 may vary by intentionally using density modifying agents such as blowing agents or foam additives depending on required application.

Other embodiments for preparation of polymer pads 12 include pre-formed methods such as molding through injection, molding through pour and annealing, extrusion, and other foamed formation methods. The "pre-formed" pads 12 may also be assembled, or attached, to the shell or liner 14 that defines the glove, and subsequently encapsulated as discussed below. The preformed pads may be adhered to the textile liner 14 by methods including direct injection, adhesion, ultrasonic welding, hot welding, sewing, and other methods of attaching the pad 12 to the liner 14. FIG. 4A illustrates a pad 12*a* exploded from the liner 14 to show a bonding structure 39 for attaching the pad to the liner. The bonding structure 39 may be an adhesive applied by a nozzle connected to a supply of adhesive, a portion of softened resin (for example, formed by ultrasonic welding of the resin to synthetic fibers in the liner). or melt-bonding by heating a connecting portion of the pad.

Figure 3C:
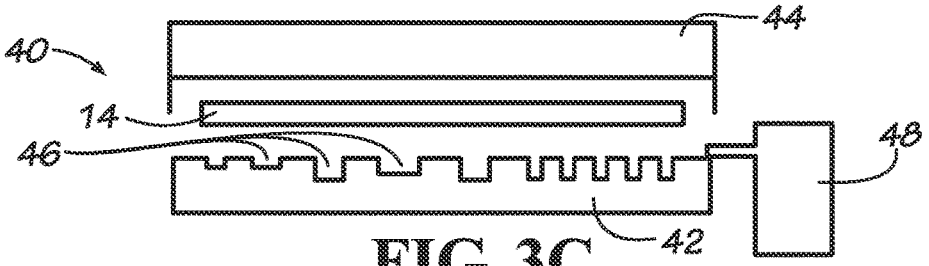
FIG. 3C illustrates an injection mold for assembly of the polymer pads and the liner.
Figure 3D:
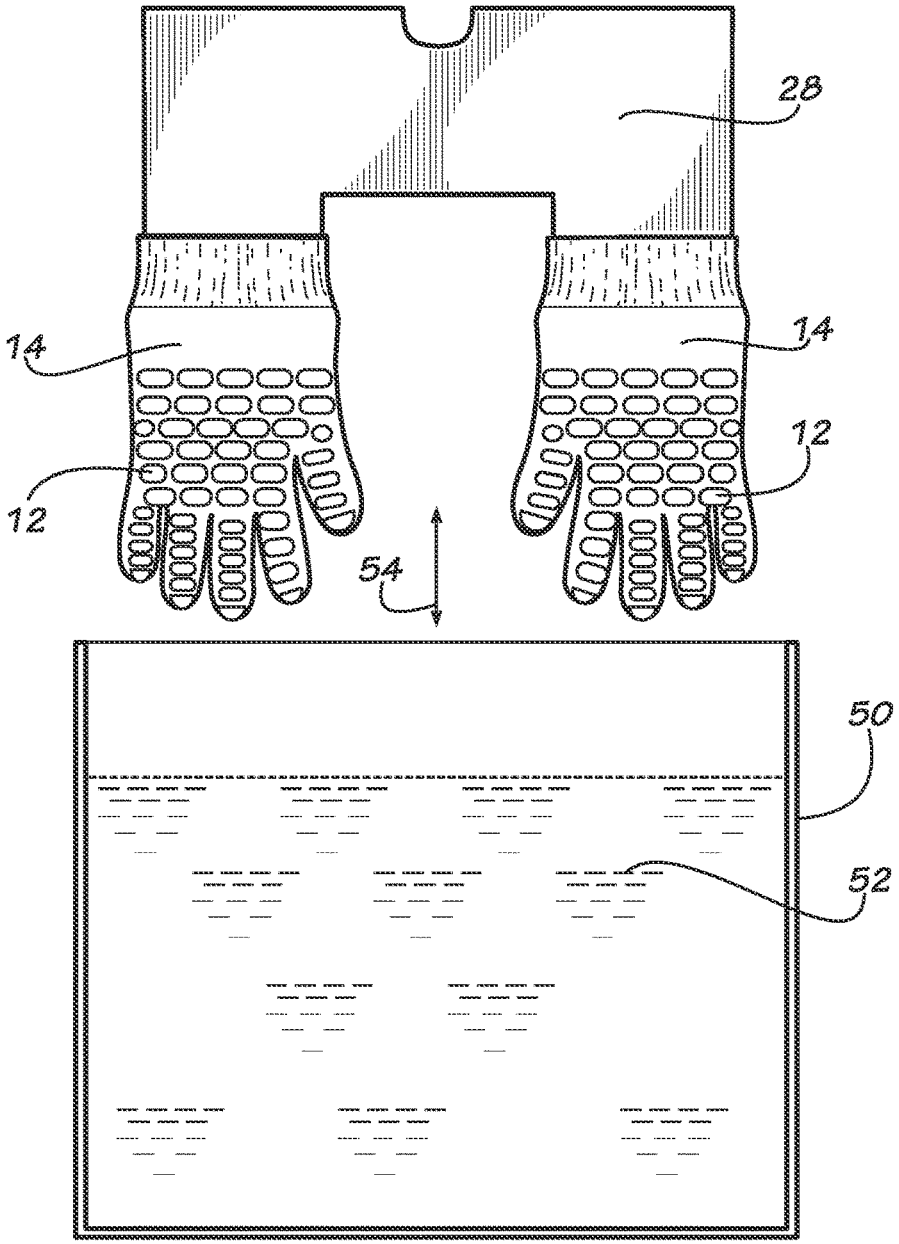
FIG. 3D illustrates the liner with attached printed pads and a dipping bath of a polymer mixture for coating the liner and the pad during encapsulation.

FIG. 3C illustrates a schematic diagram of an injection mold 40 that receives a liner 14 between opposing dies 42, 44. In the illustrated embodiment, die 42 defines recesses 46. Upon closing the mold dies together, the recesses 46 receive resin injected from a supply 48 into the mold 40. The resin defines the pads 12 that attach to the liner 14. The mold 40 is heatable for curing the resin. In an alternate embodiment, the mold 40 receives a pre-formed pad for heatingly attaching to the liner.

Figure 4B:
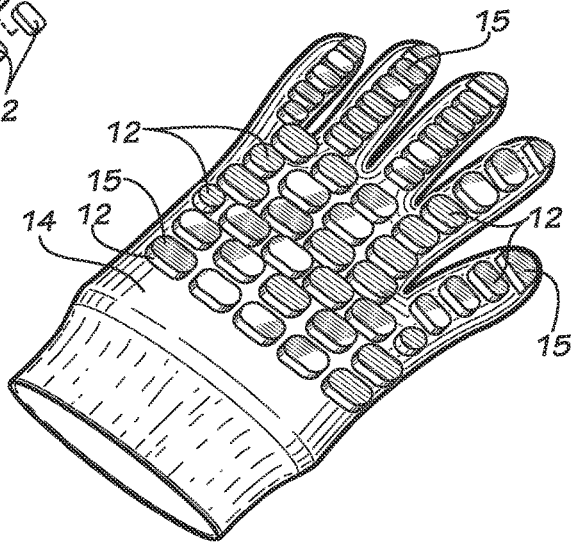
FIG. 4B illustrates an alternate embodiment of a liner with screened polymer pads topically coated with a flock for assisting bonding of the encapsulation layer during subsequent processing for a cured/hardened impact polymer coated glove.

Embodiments that encapsulate using a water-based coagulant system preferably treat the polymer pad 12 with a bonding agent while still in the paste or liquid state. FIG. 4B illustrates the polymer pads 12 treated with a flock 15 as the bonding agent. The bonding agent for the treatment of the polymer pads 12 includes a primer 13 (illustrated in FIG. 8D) or other treatment to allow proper wetting and physical bonding of the water based polymer to the polymer pads. The treatment primer 13 may be a polyurethane and/or cyanoacrylate adhesive primers. The flock 15 may be physical cotton or other textile strands or a hydrophilic powder material applied as a topical surface treatment. The flock 15, which may be charged electrostatically, transfers to pads 12, and alternatively to the pads and the liner, while the pads are in paste (uncured) form. The resulting finished surface has a velvet textural treatment, such as a layer that is substantially evenly distributed and defining a short dense pile to provides an appropriately thick receiving layer for the water based polymer into which the flocked liner/pads are dipped. The primer 13 or flock 15 treatment remains at the pad-to-polymer interface to facilitate bonding encapsulation of the coating polymer 13 with the polymer pad 12. The layer of flock provides a pile for soaking reception and holding of the encapsulating polymer discussed below. In an alternate embodiment, the flock 15 mixes within the polymer paste used for screening to form the polymer pad 12. The intermixed polymer screens through the openings 22 into attaching contact with the liner 14. As shown in FIG. 4B, at least some portions of the flock 15 extends outwardly of the polymer pad 12. The extending portions of the flock engage the polymer coating 16 to physically bond the resilient pad 12 to the polymer coating 16. The use of the flock 15 (intermixed or separate coating treatment) facilitates use of "water-based" polymers, such as nitrile, natural rubber, neoprene, and other "water based" polymers that may preferably be dipped using a coagulant, or salt based system. Accordingly, the treated polymer pad 12 allows wetting, and the pad and the coating 16 physically and chemically lock together.

Encapsulating Polymer Coating 16

Figure 5A:
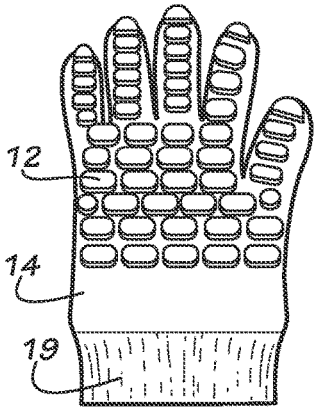
FIGS. 5A-5D illustrate in alternate views an exemplary embodiment of a cured/hardened impact and/or anti-vibration polymer coated liner with an additional cuff or accessory as needed.
Figure 5B:
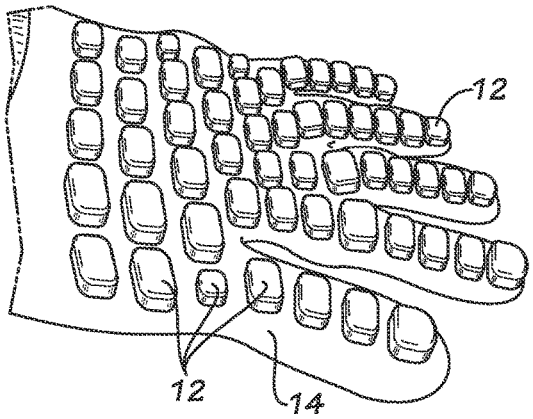
Figure 5C:
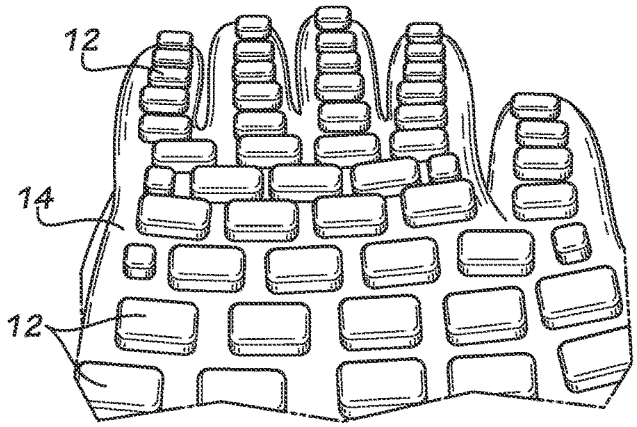
Figure 5D:
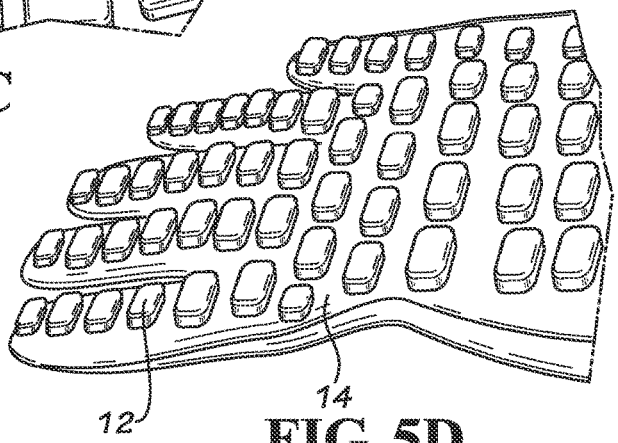
Figure 5E:
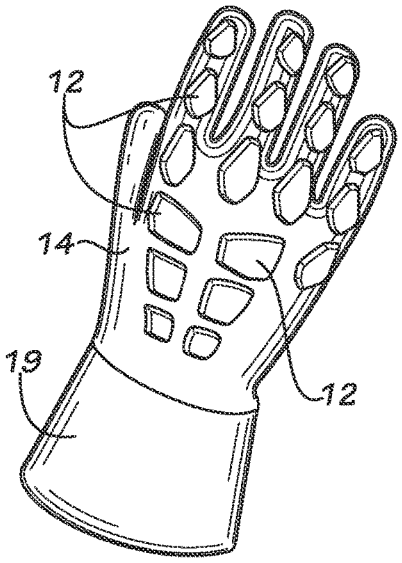
FIGS. 5E and 5F illustrate another exemplary embodiment of a cured/hardened impact and/or anti-vibration polymer coated liner having a different pattern of pads and with an extending wrist cuff.
Figure 5F:
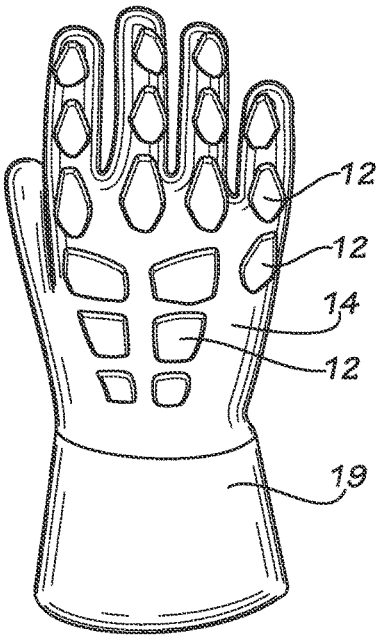

Performance driven polymer pads 12 screened/coated on liners 14 or fabric sheets are further assembled as needed. Typical processing includes further assembling unfinished cut/sewn liners and adding multiple panels to make a completed 3D glove. Cuff assembly may include adding a PVC, neoprene, or other fabric wrist and cuff generally 19, attached such as by sewing. This process finalizes the coated, finished shell ready for encapsulation process. FIG. 5 illustrates an example embodiment of cured/hardened impact and/or anti-vibration polymer pad attached liner 14 with additional cuff or accessory as needed. FIG. 5A illustrates a back view of an illustrative embodiment of a cured/hardened impact and/or anti-vibration polymer pad attached liner with the additional cuff. FIG. 5B illustrates a thumb side view of the pad attached liner. FIG. 5C illustrates another exemplary embodiment of a cured/hardened impact and/or anti-vibration polymer coated liner having a different pattern of pads 12 and with an extending wrist cuff.

With reference to FIG. 3C, finished shells carried on the form 28 are coated by dipping in a bath 50 containing fluidal polymer to encapsulate the impact and/or anti-vibration polymer pad 12 within the continuous coating 16. The liners 14 with attached pads 12 are loaded onto the proper hand mold former 28, which is often made of either aluminum, steel, plastic or ceramic. The loaded liners 14 are then processed by dipping (shown by the arrow 54) the carrier form 28 to cover part or all of the loaded liner.

Figure 8A:
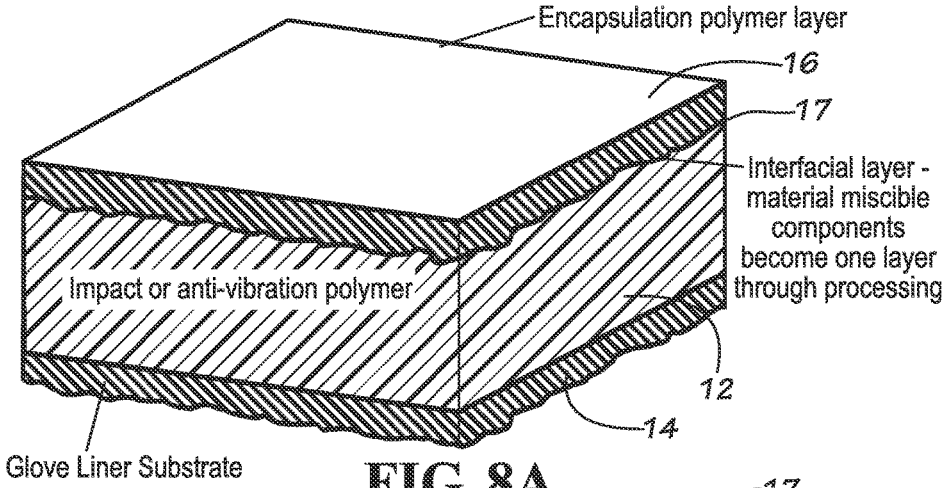
FIG. 8A illustrates a detailed graphical cross-sectional view of the relationship between the glove substrate or liner, the polymer pad, and the encapsulation layer.
Figure 8B:
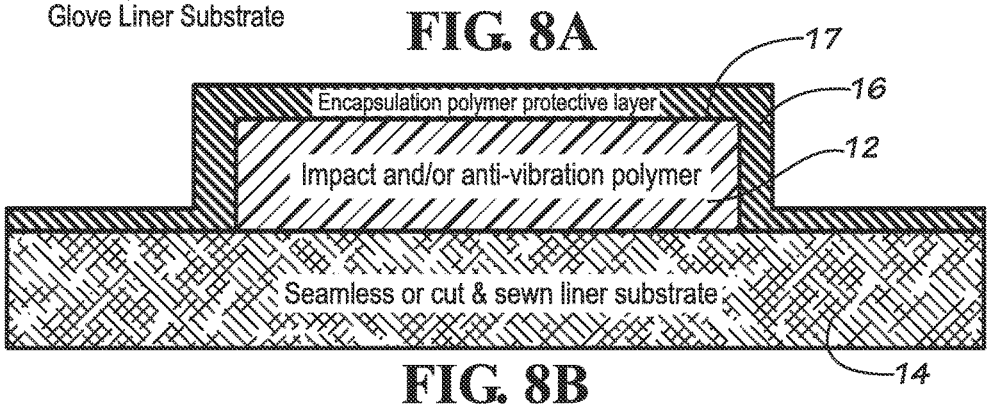
FIG. 8B illustrates a schematic graphical cross-sectional view showing the relationship between the glove substrate, the polymer pad, and the encapsulation layer.
Figure 8C:
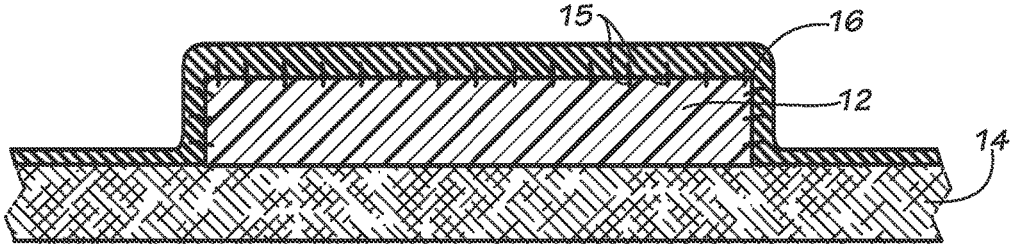
FIG. 8C illustrates an alternate embodiment having a flock material that physically bonds the polymer pad to the encapsulation layer.
Figure 8D:
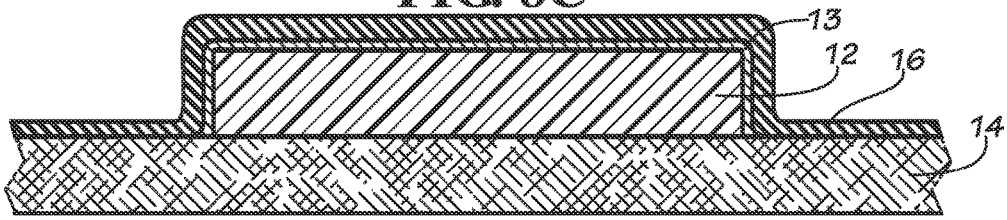
FIG. 8D illustrates an alternate embodiment having a primer that physically bonds the polymer pad to the encapsulation layer.

The polymer coating 16 is typically between 0.02 mm to 2 mm thickness over the liner 14 and pads 12 to create a continuous film. With reference to FIGS. 8A and 8B, the film polymer 16 and the polymer pads 12 have an affinity through this chemical and physical process, defining in situ the interfacial layer 17, and bond together as one layer unitarily encapsulating the polymer pad 12 within the film 16. FIG. 8C illustrates the alternate embodiment having the flock 15 that receives and holds the polymer and physically bonds the polymer pad 12 to the encapsulation layer 16 of the polymer film. FIG. 8D illustrates the alternate embodiment having the primer 13 that physically bonds the polymer pad 12 to the encapsulation layer 16 of the polymer film. (Alternatively, FIG. 8D may be viewed as schematically illustrating the flock 15 rather than the primer 13.)

Typical dipping process includes straight dipping of the shell directly into a liquid polymer to continuously coat. Other dipping includes coagulant-based dipping which includes salts to destabilize the polymer and coat the shell. This is then processed through the oven and/or liquid heated process to cure the polymer. The dipping process alone is typically known in the general market. An alternate embodiment thereafter sprays granulates or grit materials onto the coating, such as on the palm portion. The granulates may be a resilient yet stiff material such as PVC granulates. The coated granulate glove may then be re-dipped to further encapsulate the granulates. The granulates cause a rough textured surface that provides slip resistance when gripping equipment and articles.

Gloves are then removed from the hand mold formers 28 and processed further as necessary.

As noted above, preformed pads 12 made from other methods such as injection molding, foam extrusion, and various other methods may also be adhered to the textile liner by methods including direct injection, adhesion, ultrasonic welding, hot welding, sewing, and other potential methods.

Finishing

Typical finishing processing includes trimming where necessary, logo printing, further sewing to add accessories such as Velcro cuff, and packaging.

Figure 6A:
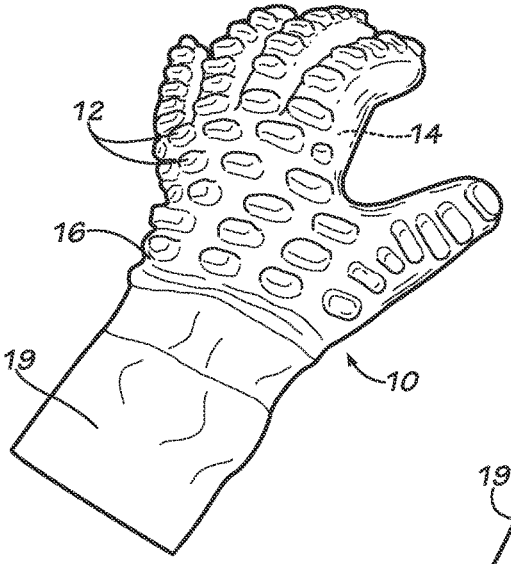
FIGS. 6A-6G illustrate an exemplary embodiment of a finished glove with encapsulated impact polymer pads inside a protective polymer coating in accordance with the present invention.
Figure 6B:
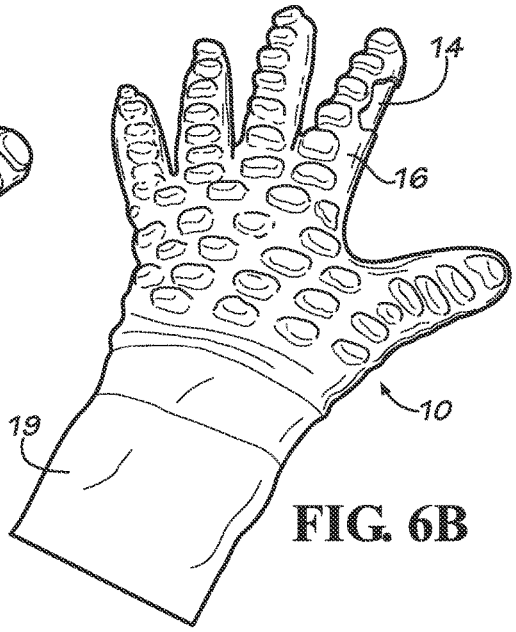
Figure 6C:
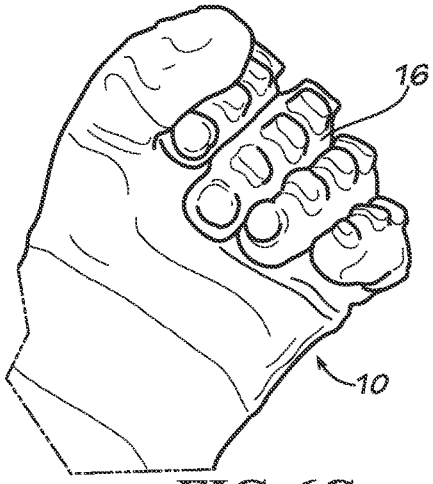
Figure 6D:
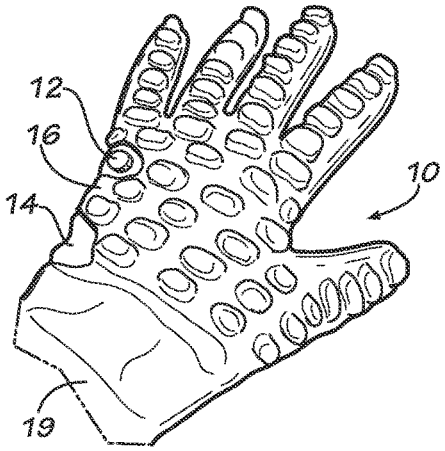
Figure 6E:
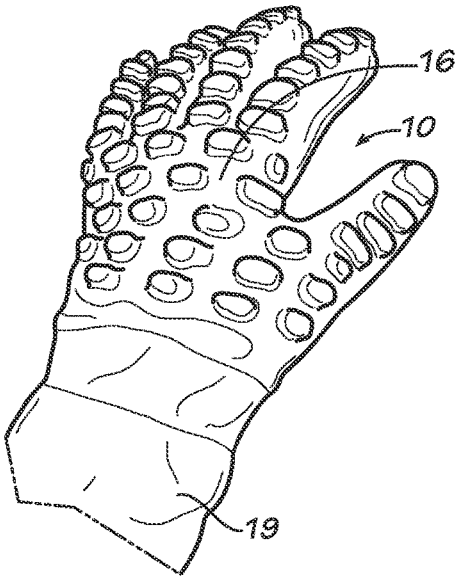
Figure 6F:
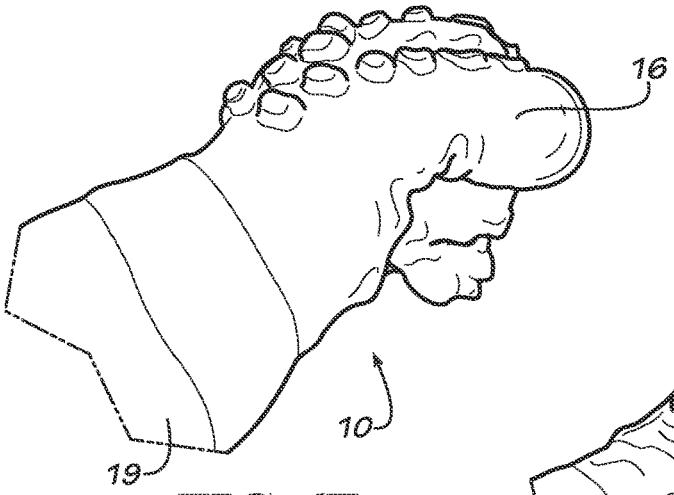
Figure 6G:
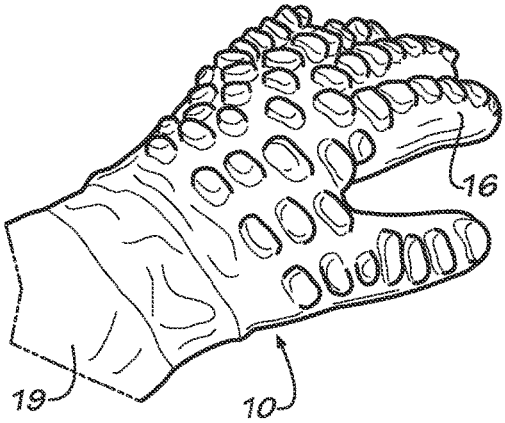

The resulting encapsulated polymer pad 12 is typically at a height/thickness layer significantly more thick than that of the polymer coating 16 that may further coveringly coat other parts of the glove liner. The increased height creates an additional protection barrier, while maintaining the continuous polymer layer through the coated portions. The continuous exterior film layer is typically intended to protect the hand of a person using the glove 10 from chemicals and/or mechanical exposure. The encapsulated polymer pads 12 are resilient to various mechanical exposures and may range from soft to hard depending on the required performance. FIG. 6 illustrates a finished glove 10 with encapsulated impact polymer pads 12 inside the protective polymer coating 16. FIG. 6A shows an exemplary embodiment of the glove 10 being worn for use. FIG. 6B illustrates the user flexing the hand inside the glove in order to spread the fingers for gripping, pushing or pressing. FIG. 6C illustrates the user clenching a first within the glove. FIG. 6D illustrates the user flexing the hand inside the glove. FIG. 6E illustrates the glove in perspective view. FIGS. 6F and 6G illustrate the glove in perspective view while being worn for use, for example but not limited to, an industrial application, for gripping such as gripping a tool, handle or article.

Figure 7A:
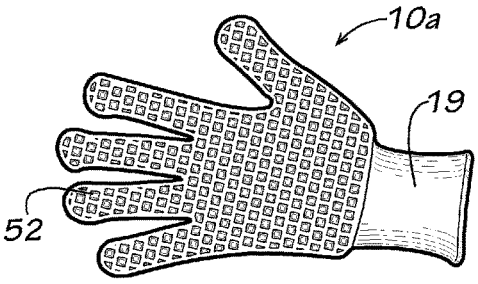
FIGS. 7A-7H illustrate examples of typical finished gloves in accordance with the present invention illustrating alternate pad patterns providing purpose-driven coverage for a glove.
Figure 7B:
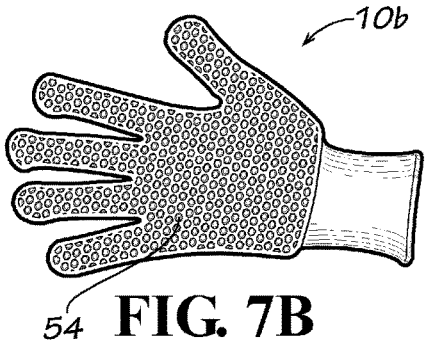
Figure 7C:
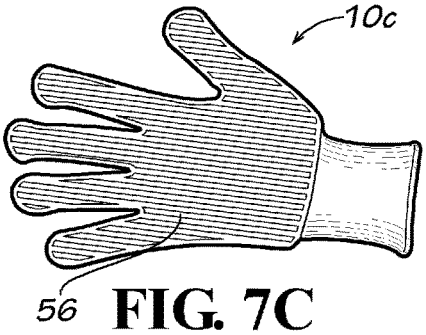
Figure 7D:
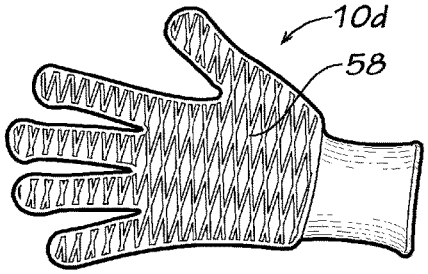
Figure 7E:
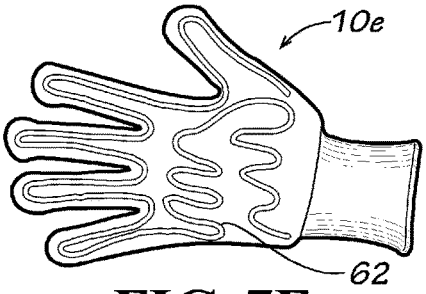
Figure 7F:
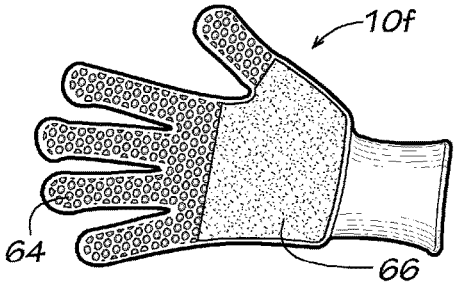
Figure 7G:
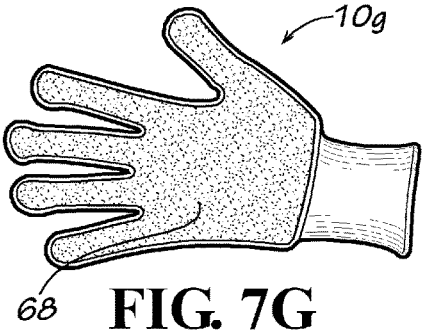
Figure 7H:
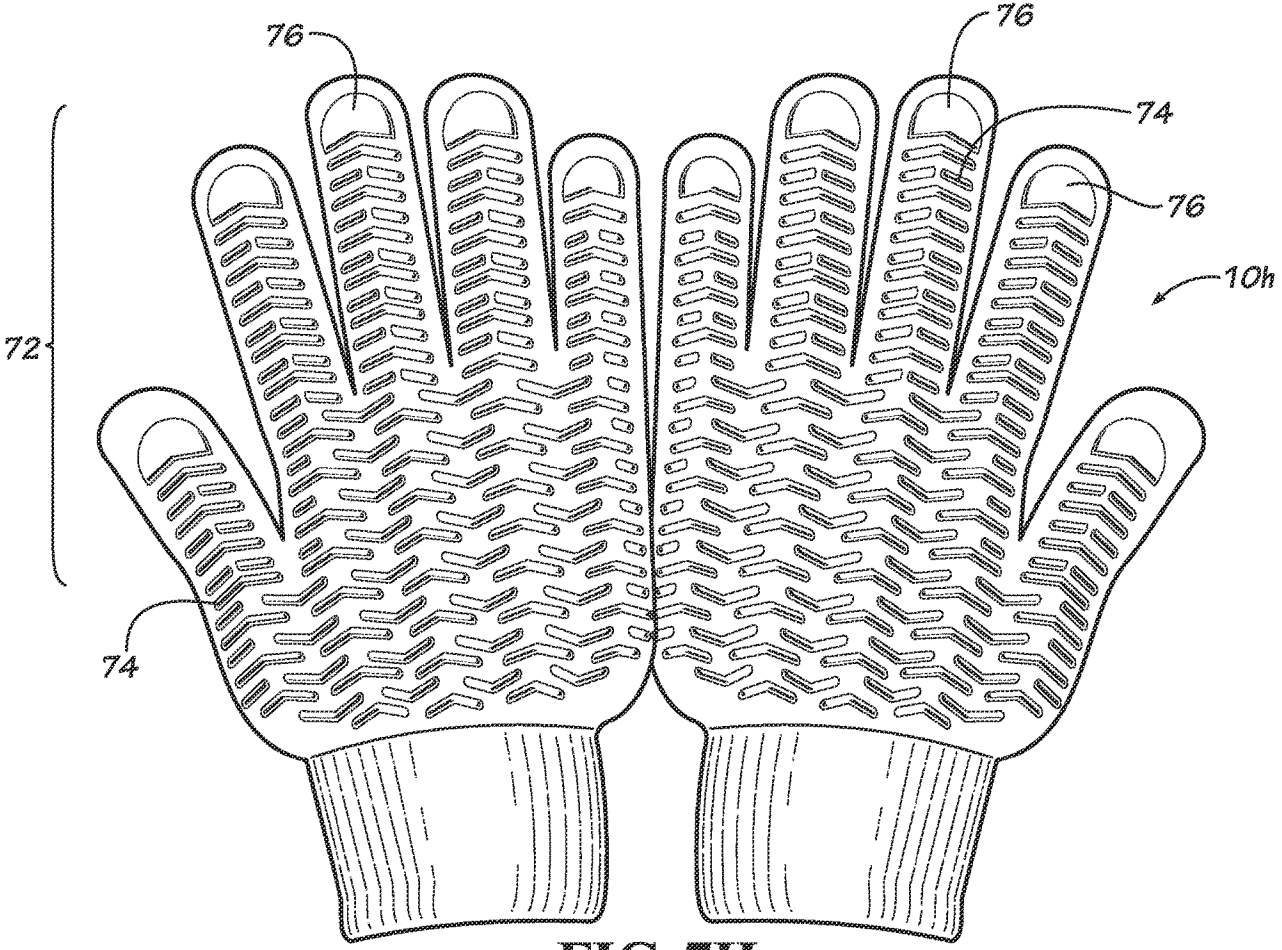

FIGS. 7A-7H illustrate examples of alternate embodiments of finished gloves 10*a*-10*h* with range or variety of pad patterns providing purpose-driven coverage for applications requiring or assisted by use of a glove. FIG. 7A illustrates a glove 10*a* with a pattern of spaced-apart blocks 52 for the pads 12. FIG. 7B illustrates a glove 10*b* with a pattern of spaced-apart dots 54 for the pads 12. FIG. 7C illustrates a glove 10*c* with a pattern of substantially parallel strips or narrow bands 56 for the pads 12. FIG. 7D illustrates a glove 10*d* with a crisscross pattern 58 of narrow strips or lines of polymer for the pads 12. FIG. 7E illustrates a glove 10*e* with an accurate lined pattern 62 for the pads 12 appropriate for gripping an article with the glove. FIG. 7F illustrates a glove 10*f* with a pattern of dots 64 disposed on the finger envelopes of the liner 14 and a broad palm pad 66 in the palm portion of the liner 14. FIG. 7G illustrates a glove 10*g* with a palm coat 68 of the polymer attached to the palm portion and extending as coatings 70 along the respective finger envelopes. FIG. 7H illustrates a glove 10*h* with a pattern 72 of spaced-apart blocks 74 on opposing exterior sides of the liner 14 with fingertip pads 66.

Figure 9A:
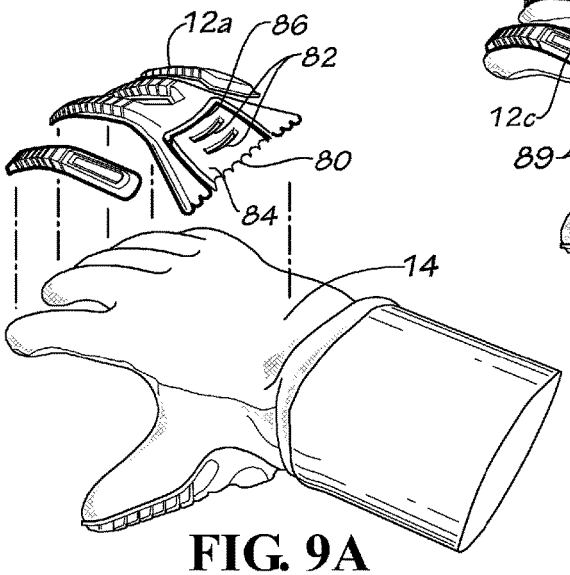
FIG. 9A illustrates in exploded perspective view an alternate embodiment having a plurality of preformed rubber pads for attaching to the textile liner prior to encapsulation.
Figure 9B:
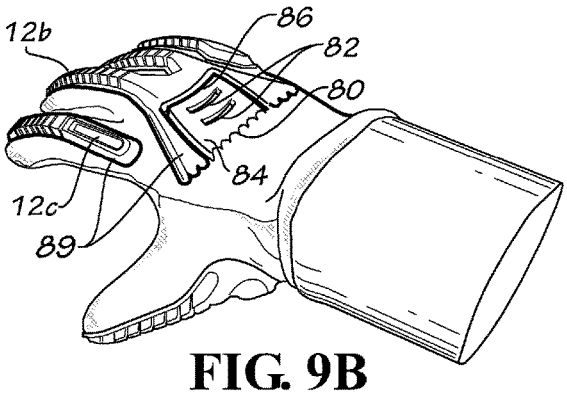
FIG. 9B illustrates the alternate embodiment depicted in FIG. 9A with a plurality of preformed rubber pads attached to the textile liner prior to encapsulation.

FIG. 9A illustrates in exploded view an alternate embodiment of the glove 10 having a plurality of preformed rubber pads 12*a-c* for attaching to the textile liner 14 that defines the glove prior to encapsulation. The rubber pads 12*a-c* may be formed by a molding process to form pads of more complicated structures such as those illustrated. In the illustrated embodiment, the pad 12*a* attaches to the liner 14, such as illustrated in FIG. 9B on a wrist-proximate back portion of the glove liner. The pad 12*a* has a base portion 80 and defines two openings 82 within a central portion 84 extending from an edge 86 to the base portion n. Additional representative pads 12*b* and 12*c* are shown. The pad 12*b* defines elongated protective pads that attach to the finger envelopes of the liner 14; a separate pad 12*c* attaches as a protective pad on the thumb envelope. The pads 12*a*, 12*b*, and 12*c* attach to the liner 14 such as by direct injection, adhesion, ultrasonic welding, hot welding, sewing with a thread 89, and other attachment mechanisms and methods.

Figure 10:
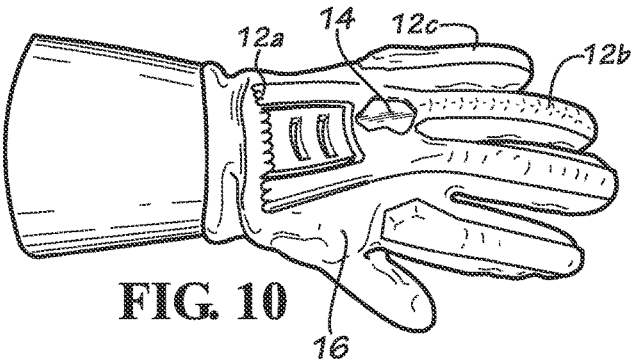
FIG. 10 illustrates the alternate embodiment having the preformed rubber pads attached to textile liner post dipping/encapsulation.

FIG. 10 illustrates the alternate embodiment of the glove shown in FIG. 9 after the dipping/encapsulation step to seal or encapsulate the preformed rubber pads 12*a*, 12*b*, and 12*c*, with the textile liner 14 within the chemical/fluids resistant coating 16. The encapsulation material 16 further seals the interstices defined by the woven fabric of the textile liner 14.

Figure 11:
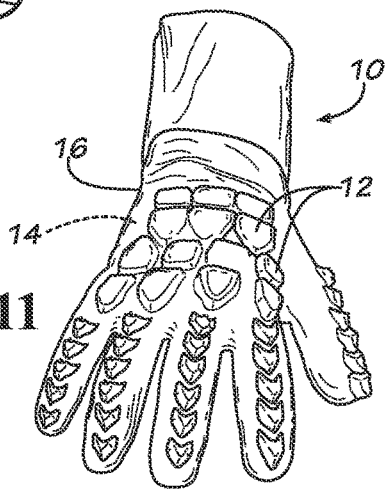
FIG. 11 illustrates a finished product made using the described print screening method in accordance with the present invention.

FIG. 11 illustrates a finished product glove 10 made using the described screening method in accordance with the present invention. The plurality of pads 12 are disposed relative to the textile fabric 14 that defines the hand and finger receiving body of the glove and encapsulated with the polymer coating 16.

The polymer pads 12 include formation discussed above for inline manufacturing per the description or pre-formed methods including molding by injection, molding through plate pouring and annealing, extrusion formation, foamed rubber formation, and other. Assembly of these include direct injection/processing, adhesion, ultrasonic welding, heat welding, sewing, and other attachment methods.

The liners 14 include cut and sew liners in both ambidextrous and hand specific (i.e, left and right specific) form, using seamless knitted liners or woven liners. Materials useful for the liners 14 include cotton, polyester, TC, polycotton, nylon, acrylic, aramids, polyethylenes, composite fibers including glass, stainless steel, lycra/spandex, polypropylene. Formats include terry, canvas, wafted, knitted, and 3D monofilament.

The gloves 10 provide cut resistance, with embodiments that include the above liners with materials for purpose of additional cut resistance ranging from level 1 to 5 on EN388 scale and from level 1-5 on ANSI and ISO blade cut resistance test. Further, the gloves 10 feature puncture-resistant formats per above with materials intended to increase puncture resistance such as tightly woven or tightly knitted cotton, aramids, polyethylenes, and other related materials.

The polymers and rubbers useful with the present invention include silicone, polyvinyl chloride, nitrile, latex, polyurethane, acrylics, and neoprene.

Cuff styles are conventional in the trade, and include welded polymer, sewn polymers, textile, neoprene, VELCRO, and elasticized bands.

Placement/orientation of the pads 12 are suitably configured for impact protection, ranging from and including back of hand down to fingertips and palm side of hand, and longitudinally along the finger envelopes.

Styles include colors for basic design per safety requirements, reflective and high visibility colors, etc.

The thickness of the polymer pad 12 range from about 1 mm to 10 mm and the encapsulation layer thickness ranges from about 0.08 mm to about 2 mm.

The resulting glove 10 provides thermal resistance, impact resistance, vibration resistance, grip support, and durability improvement while resisting chemical penetration and sharps penetration.

The pad 12 patterns including palm and back of hand patterns based on the particular use or environment for the glove, and range from small 2 mm pads of various geometric shapes in small regions of the glove up to complete 100% coverage of the specific glove surface. FIGS. 7A-7H illustrate alternate embodiments of polymer pads 12 (illustrated prior to encapsulation) as discussed above.

The following describes illustrative non-limiting embodiments of the encapsulated glove with purpose-drive components according to the present invention.

Embodiment 1

A knitted cotton liner or shell with interlocked fibers, cut as opposing panels for a palm and fingers and sown together to form an envelope for receiving a hand of a user. The opposing panels are screened using the die and screening process described above in reference to FIG. 3A. The form 28 receives the liner 14 with the attached polymer pads 12, and dipped in a bath of a PVC polymer. In a first embodiment thereof, the encapsulation polymer is 100% PVC; in a second embodiment, the encapsulation polymer is a PVC/nitrile blend. The coated liner cures with a suitable dwell time in an oven heated appropriately.

Embodiment 2

A jersey-type liner 14 forms a woven shell for the glove. The liner 14 is screened to attach polymer pads 12, and the intermediate assembly is dipped in a PVC polymer bath to apply the encapsulation coating 16. The coated glove dwells in an oven heated appropriately for curing the polymer.

Embodiment 3

A pre-formed PVC-based pad 12 is perimeter sown with a thread to attach the pad to a liner 14 to form an intermediate assembly. The form 28 receives the intermediate assembly and the assembly then is dipped into a PVC bath. The PVC bath coats the intermediate assembly, and following appropriate dwell time and cure temperature in an oven, provides an encapsulated glove.

Embodiment 4

A textile liner 14 (either woven or knitted) receives purposed-driven polymer pads 12 to form an intermediate assembly. The intermediate assembly receives a topical application of a plurality of strands of cotton flock 15 while the polymer paste remains viscous and before final curing of the polymer. The strands of flock 15 engage interlockingly with the pads 12 with a portion of the flock extending therefrom. The form 28 receives the flocked intermediate assembly for dipping in a water-based polymer of a coagulant and a nitrile-based material. The extending portions of the flock 15 interlock with the polymer. The coated assembly cures within an oven in an appropriate dwell time and temperature. The flock physically connects the pads 12 and the encapsulation coating 16.

Embodiment 5

A textile liner 14 (either woven or knitted) receives purposed-driven polymer pads 12 to form an intermediate assembly. In a first embodiment, the polymer pads 12 are screened into attachment to the liner. In a second embodiment, the polymer pads are preformed and attached with an adhesive or sown with threads. The intermediate assembly receives a topical application of a plurality of strands of cotton flock 15 while the polymer paste remains viscous and before final curing of the polymer. The strands of flock 15 engage interlockingly with the pads 12 with a portion of the flock extending therefrom. The form 28 receives the flocked intermediate assembly for dipping in a water-based polymer of a coagulant and a nitrile-based material. The extending portions of the flock 15 interlock with the polymer. The coated assembly cures within an oven in an appropriate dwell time and temperature. The flock physically connects the pads 12 and the encapsulation coating 16.

The purpose-driven glove disclosed herein can be made and executed without undue experimentation in light of the present disclosure. While the apparatus and methods of this invention have been described in terms of illustrative embodiments, it will be apparent to those of skill in the art that variations may be applied to the apparatus and in the method steps or in the sequence of steps thereof described herein without departing from the concept, spirit and scope of the invention. All such similar substitutes and modifications apparent to those skilled in the art are deemed to be within the spirit, scope and concept of the invention as defined by the appended claims.

What is claimed is:

1. A work glove, comprising:

a sheet formed to define a hand-receiving cavity having a palm portion and opposing back portion with an elongated thumb tube and four elongated finger tubes extending therefrom and an opposing cuff portion;

at least one resilient pad attached to the sheet in a portion selected for being resistant to industrial loading;

a polymer coating that encapsulates at least a portion of an exterior surface of the sheet and the at least one resilient pad therein; and a miscible layer between an exterior surface of the resilient pad and the polymer coating, the miscible layer comprising a mixture of a distal portion of the resilient pad, and a portion of the polymer coating, whereby the at least one resilient pad, the miscible layer, and the polymer coating being a continuously unitary assembly on an exterior of the work glove resists chemical penetration therethrough and resists industrial loading during use of the work glove for work glove purposes.

2. The work glove as recited in claim 1, wherein the resilient pad comprises a block defined by an in-place removable screen mold that seats on the sheet to dispose an opening defined therein that receives a curable resin material that attaches to the selected portion of the sheet.

3. The work glove as recited in claim 2, wherein the curable resin comprises a paste having a viscosity sufficient for retaining a defined shape following removal of the in-place screen mold prior to curing.

4. The work glove as recited in claim 2, further comprising a plurality of flock of which a portion of the flock extends outwardly of the curable resin, whereby the extending portions of the flock engage the polymer coating to mechanically bond the resilient pad to the polymer coating.

5. The work glove as recited in claim 4, wherein the flock comprises a powder.

6. The work glove as recited in claim 4, wherein the flock comprises fiber strands.

7. The work glove as recited in claim 4, wherein the flock comprises a topical application to the polymer pads.

8. The work glove as recited in claim 4, wherein the flock intermixes with the resin material.

9. The work glove as recited in claim 4, wherein the polymer coating is aqueous.

10. The work glove as recited in claim 1, wherein the resilient pad comprises a pre-formed body attached to the selected portion of the sheet.

11. The work glove as recited in claim 10, further comprising an adhesive that attaches the pre-formed body to the sheet.

12. The work glove as recited in claim 10, further comprising a stitching thread that attaches the pre-formed body to the sheet.

13. The work glove as recited in claim 10, wherein the pre-formed body attaches by bonding the pre-formed body to the sheet.

14. The work glove as recited in claim 13, wherein the bonding comprises a heat bond attachment of a partially softened portion of the pre-formed body to the sheet.

15. The work glove as recited in claim 11, wherein the bonding comprises an ultrasonic bond attachment of the pre-formed body to the sheet.

16. The work glove as recited in claim 10, wherein the pre-formed body attaches by injection molding the pre-formed body to the sheet disposed concurrently in a mold.

17. The work glove as recited in claim 1, wherein the polymer coating has a thickness of about 0.02 mm to about 10.0 mm.

18. The work glove as recited in claim 1, wherein the resilient pad comprises one or more materials selected from the group comprising: silicone, polyvinyl chloride, nitrile, latex, polyurethane, acrylic plastic, and neoprene.

19. The work glove as recited in claim 1, wherein the polymer coating comprises one or more materials selected from the group comprising: silicone, polyvinyl chloride, nitrile, latex, polyurethane, acrylic plastic, and neoprene.

20. The work glove as recited in claim 1, wherein the sheet comprises a textile sheet.

21. A method of making a work glove, comprising the steps of:

(a) forming a hand-receiving cavity with a sheet and having a palm portion and opposing back portion with an elongated thumb tube and four elongated finger tubes extending therefrom and an opposing cuff portion;

(b) attaching, at least one resilient pad in a portion selected for being resistant to industrial loading with a polymer material having a viscosity sufficient to retain the shape of the resilient pad through processing of encapsulation and curing;

(c) encapsulating at least a portion of an exterior surface of the sheet and the at least one resilient pad within a continuous polymer coating;

(d) forming a miscible layer between the at least one resilient pad and the polymer coating of intermixed distal portions thereof; and (e) curing the encapsulated at least one resilient pad, the polymer coating, and the miscible layer within a heated environment for a predetermined dwell period as an assembly for defining the work glove with the polymer coating that resists chemical penetration therethrough and which resilient pad resists industrial loading during use thereof for glove work purposes.

22. The method as recited in claim 21, wherein attaching comprises the steps of:

seating an in-place screen mold on the sheet to dispose an opening defined in the screen mold adjacent the selected portion of the sheet;

depositing a curable resin material within the opening, which resin material attaches in situ to the selected portion of the sheet; and removing the in-place screen mold leaving the curable resin material attached to the sheet.

23. The method as recited in claim 22, wherein the curable resin material comprises a paste having a viscosity sufficient for retaining a defined shape following removal of the in-place screen mold.

24. The method as recited in claim 21, further comprising the step of providing the resilient pad with a plurality of flock and a portion of the flock extending outwardly of the polymer pad, whereby the extending portions of the flock engage the polymer coating to mechanically bond the resilient pad to the polymer coating.

25. The method as recited in claim 24, wherein the flock is topically applied.

26. The method as recited in claim 24, wherein the flock intermixes in the resin paste.

27. The method as recited in claim 21, wherein encapsulating comprises the steps of:

providing a bath of a polymer material;

dipping the formed sheet having the attached at least one resilient pad into the bath for a predetermined period to transfer a portion of the bath polymer material thereto as the continuous polymer coating; and removing the dipped encapsulated formed sheet from the bath.

28. The method as recited in claim 27, wherein the bath is aqueous.

29. The method as recited in claim 28, further comprising the step of providing the resilient pad with a plurality of flock intermixed therein and a portion of the flock extending outwardly of the polymer pad, whereby the extending portions of the flock engage the polymer coating to physically bond the resilient pad to the polymer coating.

30. The method as recited in claim 21, wherein attaching comprises the steps of:

forming the at least one resilient pad in a molding device; and attaching the formed at least one resilient pad to the sheet with an adhesive.

31. The method as recited in claim 21, wherein attaching comprises the steps of:

forming the at least one resilient pad in a molding device; and bonding the formed at least one resilient pad to the sheet.

32. The method as recited in claim 31, wherein bonding comprises heating a portion of the resilient pad to soften sufficiently to bond to the sheet.

33. The method as recited in claim 31, wherein bonding comprises ultrasonic welding a portion of the resilient pad to the sheet.

34. The method as recited in claim 21 wherein attaching comprises the steps of:

forming the at least one resilient pad in a molding device; and stitching with a thread to connect the formed at least one resilient pad to the sheet.

35. The work glove as recited in claim 1, wherein the resilient pad is greater than about 2 mm in geometric shape.

36. The work glove as recited in claim 1, wherein the resilient pad has a thickness greater than about 3 mm to about 10 mm.

37. The work glove as recited in claim 1, wherein the resilient pad is greater than about 2 mm in geometric shape and has a thickness greater than about 3 mm to about 10 mm.

38. The work glove as recited in claim 1, wherein the resilient pad is greater than about 2 mm in geometric shape and has a thickness greater than about 3 mm to about 10 mm; and the polymer coating has a thickness greater than about 0.08 mm to about 2 mm.

39. A work glove, comprising:

a knitted fabric sheet formed to define hand-receiving cavity having a palm portion and opposing back portion with an elongated thumb tube and four elongated finger tubes extending therefrom and an opposing cuff portion;

at least one resilient pad attached with a polymeric material to the sheet in a portion selected for being resistant to industrial loading, the polymeric material having a viscosity sufficient to retain the shape of the pad through processing of encapsulation and curing;

a polymer coating applied to the fabric sheet having the at least one resilient pad, which polymer coating encapsulates at least a portion of an exterior surface of the sheet and the at least one resilient pad therein; and a miscible layer between an exterior surface of the resilient pad and the polymer coating, the miscible layer comprising a mixture of a distal portion of the resilient pad and a portion of the polymer coating, whereby the at least one resilient pad, the miscible layer, and the polymer coating being cured as a continuously unitary assembly on an exterior of the work glove resists chemical penetration therethrough and resists industrial loading during use of the work glove for work glove purposes.

* * * * *